US012193542B2

(12) United States Patent
Juckelandt et al.

(10) Patent No.: US 12,193,542 B2
(45) Date of Patent: Jan. 14, 2025

(54) SHOE UPPER

(71) Applicant: adidas AG, Herzogenaurach (DE)

(72) Inventors: Christoph Juckelandt, Fuerth (DE); Dominik Sandreuter, Aurachtal (DE)

(73) Assignee: adidas AG, Herzogenaurach (DE)

( * ) Notice: Subject to any disclaimer, the term of this patent is extended or adjusted under 35 U.S.C. 154(b) by 489 days.

(21) Appl. No.: 16/555,765

(22) Filed: Aug. 29, 2019

(65) Prior Publication Data

US 2020/0068995 A1 Mar. 5, 2020

(30) Foreign Application Priority Data

Sep. 3, 2018 (DE) ..... 10 2018 214 918.6

(51) Int. Cl.
*A43B 23/02* (2006.01)
*A43D 43/06* (2006.01)

(52) U.S. Cl.
CPC ..... *A43B 23/0245* (2013.01); *A43D 43/06* (2013.01)

(58) Field of Classification Search
CPC ..... A43B 23/0295; A43B 23/0235; A43B 23/0255; A43B 23/024; A43B 3/126; A43B 1/04; A43B 23/027; A43B 3/242; A43B 3/122; A43B 3/0052; A43B 1/05; A43B 1/06; A43B 23/086; A43B 23/025; A43C 11/002; A43C 11/1493; A43C 7/06
USPC ..... 36/11.5, 89
See application file for complete search history.

(56) References Cited

U.S. PATENT DOCUMENTS 621,922 A * 3/1899 Kelsall ..... A43B 23/0245 D2/943
1,864,254 A * 6/1932 Meyer ..... A43B 23/024 36/11.5
2,032,206 A * 2/1936 Goldberg ..... A43B 3/126 36/11.5
2,090,675 A * 8/1937 Hadaway ..... A43B 3/126 36/43
2,158,153 A * 5/1939 Roberts ..... A43B 1/10 12/142 E
2,311,959 A * 2/1943 Nurk ..... A43B 1/04 36/11
4,095,353 A * 6/1978 Foldes ..... A43B 7/146 36/43

(Continued)

FOREIGN PATENT DOCUMENTS

CN 101309607 A 11/2008
CN 205197134 U 5/2016

(Continued)

OTHER PUBLICATIONS

Extended European Search Report issued in European Patent Application No. 19194698.7, mailed Jan. 23, 2020, pages.

*Primary Examiner* — Sharon M Prange
*Assistant Examiner* — Grady Alexander Nunnery
(74) *Attorney, Agent, or Firm* — Sterne, Kessler, Goldstein & Fox P.L.L.C.

(57) ABSTRACT

The invention concerns a shoe upper including at least a first tape and a second tape, where the first tape and/or the second tape is elastic, where the first tape includes a first edge, where a first portion of the first edge of the first tape is not attached to the second tape, and where a second portion of the first edge of the first tape is attached to the second tape.

22 Claims, 4 Drawing Sheets

(56) References Cited

U.S. PATENT DOCUMENTS

| | | | | | |
|---|---|---|---|---|---|
| 4,215,493 | A * | 8/1980 | Antonious | A43C 11/1493 | 36/51 |
| 4,442,613 | A * | 4/1984 | Dobbin | A43C 1/003 | 36/50.1 |
| 4,649,939 | A * | 3/1987 | Curtis | A43B 7/19 | 36/89 |
| 2006/0254090 | A1* | 11/2006 | Baxter | A43B 3/16 | 36/59 R |
| 2007/0107265 | A1 | 5/2007 | Mueller et al. | | |
| 2013/0340293 | A1* | 12/2013 | Lee | A43B 7/20 | 36/136 |
| 2014/0101969 | A1* | 4/2014 | Pham | A43B 13/122 | 36/11.5 |
| 2018/0064210 | A1* | 3/2018 | Turner | A43B 23/0205 | |
| 2018/0242692 | A1* | 8/2018 | Houng | A43C 11/1493 | |

FOREIGN PATENT DOCUMENTS

| | | | |
|---|---|---|---|
| CN | 205492741 | U | 8/2016 |
| CN | 107752225 | A | 3/2018 |
| CN | 107788613 | A | 3/2018 |
| CN | 108294399 | A | 7/2018 |
| CN | 208597776 | U | 3/2019 |
| DE | 202016008321 | U1 | 7/2017 |

* cited by examiner

SHOE UPPER

FIELD OF THE INVENTION

The present invention relates to a shoe upper comprising tapes, a shoe comprising the shoe upper and methods for production thereof.

BACKGROUND OF THE INVENTION

Everyday use and especially athletic use of footwear places a number of competing requirements on an article of footwear. An article of footwear should be lightweight and comfortable to wear, it should be sufficiently flexible to allow movement of the foot, yet it should provide the right level of support in order to prevent injuries and to facilitate maximum performance.

EP 3289907 A1 concerns an upper for a shoe, in particular a sports shoe, comprising at least one tape portion covering at least 50% of the upper, wherein the at least one tape portion comprises a plurality of connected tapes. A further aspect relates to an upper for a shoe, in particular a sports shoe, comprising at least one tape portion including a plurality of connected tapes, wherein the tapes are zig-zag stitched to each other on their edges.

EP 0960578 A1 relates to a shoe using a moulded bottom provided with a series of slots on the edges, or with through openings on the sole, for the application of a closed upper, made up of a fabric or leather strap that embraces the back and the neck of the foot.

US 2002129517 A1 concerns a safety shoe for protecting a person's foot from harmful injury comprising a high impact resistant outer shell, an inner dense foam insert, a solid toe cap, a heel cup, an inner sole, an outer sole and a moisture dissipating material surrounding the dense foam insert. The outer shell comprises a series of flexible interlocking sliding bands arranged surrounding the foot and folding under the foot between the outer sole and the inner sole. Entrance to the boot is by means of a rear opening having a flush mounted buckle for closing the boot around the foot.

US 2012011745 A1 concerns an article of footwear comprising a plurality of strips. The connections between continuous portions of the article can be strengthened by weaving a plurality of strips through apertures disposed in one or more continuous portions. One continuous portion may include a tongue portion of an article. The attachment of the tongue portion to a front of an article may be strengthened by weaving a plurality of strips through apertures.

It is an object of the present invention to improve the fit and wearing comfort of existing footwear, especially for athletic usage.

Footwear for ball sports, such as football, is subject to the additional requirement that a ball should be accurate to control. It is therefore a further object of the present invention to provide an article of footwear that allows an improved control of the ball.

It is a further object of the present invention to improve production methods for articles of footwear.

SUMMARY OF THE INVENTION

These objects are accomplished by a shoe upper and a method for production thereof according to the independent claims. The invention concerns in particular a shoe upper comprising at least a first tape and a second tape, wherein the first tape and/or the second tape is elastic, (a) wherein the first tape comprises a first edge, (b) wherein a first portion of the first edge of the first tape is not attached to the second tape, and (c) wherein a second portion of the first edge of the first tape is attached to the second tape.

A tape in the present context is any essentially two-dimensional item that has a larger extent in two dimensions than in a third dimension. For example, a tape may be a textile sheet, a band, a strip, etc. The textile sheet may be woven, non-woven, warp-knitted, or weft-knitted.

An important feature of the shoe upper according to the present invention is that the first tape and the second tape are only partially attached to each other at a first edge of the first tape. It is to be understood, however, that the first tape and the second tape may be attached to each other partially or completely along another edge different from the first edge, for example an edge that is essentially perpendicular or essentially parallel to the first edge. "Essentially perpendicular" means in the present context at an angle of between 60 and 120 degrees. "Essentially parallel" means at an angle of between 0 and 30 degrees.

The shoe upper according to the present invention may be for any type of shoe, for example a sports shoe, such as a running shoe, a football boot, a golf shoe, tennis shoe, etc., or for a hiking shoe, hiking boot, etc.

The shoe upper according to the present invention offers a better fit than shoe uppers known in the art. In particular, the shoe upper easily adapts to different foot shapes, for example during exercise, and may be "locked" to provide a preferable level of support when it is worn. Since the first tape and the second tape are only partially attached to each other along the first edge, the first tape and the second tape are movable and may move with respect to one another. In particular, the first portion may have slack to move with respect to the second tape when the upper is not worn or in a stretched condition. In other words, the first portion may be movable with respect to the second tape. For example, the first tape may move away from the second tape or move along a direction parallel to the surface of the second tape.

Therefore, the shoe upper offers a greater amount of flexibility, yet a comfortable level of support, than those provided by the known shoe uppers in the art. Moreover, it is easier and more comfortable to insert a foot into a shoe upper according to the present invention, since the collar opening may be opened more easily and widely.

With regard to the mentioned elasticity of the first tape and/or the second tape, the term "elastic" is to be understood from the perspective of the skilled person in the field of footwear development. Since at least one of the two tapes is elastic, the wearing comfort and the fit are improved further. The first tape and/or the second tape may, for example, comprise elastane and/or polyester.

The first tape and the second tape may at least partially overlap. At the regions of the shoe upper where the first tape and the second tap overlap, increased support may be created and provided to the feet of a wearer. It is also possible that the first tape and the second tape overlap entirely.

The first portion of the first edge of the first tape may be arranged closer to a toe region of the shoe upper than the second portion of the first edge of the first tape. Therefore, a toe region of the shoe upper is more flexible and allows the toes to move, thus improving the wearing comfort.

The second portion of the first edge of the first tape may be attached to the second tape by a stitching created by sewing. Sewing is a preferred method, which allows the second portion of the first edge of the first tape to be securely attached to the second tape even though the first portion of the first edge of the first tape is not attached to the second tape. Moreover, the transition between the first portion and the second portion of the first edge of the first tape may be very precise.

At least a part of the first tape or a part of the second tape may be in a pre-stretched condition, when the shoe upper is not worn. This is also possible for a third or fourth tape, if present, or any other tapes if present. In other words, at least a part of the first tape or a part of the second tape may be under tension when the shoe upper is neither worn by the wearer nor arranged on a shoe last or a shoe tree. This may be achieved, by applying tension to the first tape and/or the second tape prior to sewing the second portion of the first edge of the first tape to the second tape, as described in more detail below. Therefore, a tighter and better fit may be achieved. It should be noted that the first and second tapes are adaptable such that at least a part of the first tape or a part of the second tape is in a pre-stretched condition. This may be applied irrespective of whether the first portion and/or the second portion of the first edge of the first tape are (not) attached to the second tape.

The first edge of the first tape may further comprise a third portion arranged adjacent to the second portion but not adjacent to the first portion, wherein the third portion of the first edge of the first tape may not be attached to the second tape. Therefore, the flexibility and wearing comfort of the shoe upper may be improved further.

The shoe upper may further comprise a third tape, arranged at least partially between the first tape and the second tape. In particular, the third tape may partially overlap the first tape and partially overlap the second tape. In this way, the stability as well as the fit provided by the shoe upper may be improved.

The first edge of the first tape may be at least partially not attached to the third tape. For example, the first edge of the first tape may not be attached to the third tape, except possibly at a point at an end of the first edge. A point has a liner extent in any direction much less than a length of the first edge. A point may be one or more stitches. Therefore, the third tape is quite free to be movable with respect to the first tape and therefore allow the foot covered by the shoe upper to be moved comfortably.

The shoe upper may further comprise a fourth tape, wherein the third tape may comprise a first edge thereof and the fourth tape may comprise a first edge thereof. A first portion of the first edge of the third tape is not attached to the fourth tape, and a second portion of the first edge of the third tape is attached to the fourth tape. It is to be understood that the first edges of the different tapes are generally separate entities.

In other words, the third tape and the fourth tape may be only partially attached to each other along the first edge of the third tape, similar to the attachment of the first tape and the second tape along the first edge of the first tape. In particular, the first portion of the first edge of the third tape may have slack to move with respect to the fourth tape when the upper is not worn or in a stretched condition. In other words, the first portion of the first edge of the third tape may be movable with respect to the fourth tape. For example, the third tape may move away from the fourth tape or move along a direction parallel to the surface of the fourth tape. Therefore, a good wearing comfort is achieved.

The second tape may be arranged at least partially between the third tape and the fourth tape. In particular, the second tape may partially overlap the third tape and partially overlap the fourth tape. In other words, the arrangement of the first, second, third, and fourth tapes may be staggered, e.g., in an alternating manner (left/right). It has been found that this arrangement facilitates a particularly comfortable wearing experience.

A first angle formed between the first edge of the first tape and the first edge of the third tape may be less than 130 degrees, preferably less than 110 degrees. The first angle is preferably greater than 10 degrees, more preferably 30 degrees, most preferably 45 degrees. It has been found that this angular range provides a good balance between providing support to the foot on the one hand and allowing expansion of the space available for the foot during exercise on the other hand . It is to be understood that the angles are to be measured when the shoe upper is not worn and in a shape that resembles the intended shape when worn.

A second angle may be formed between the first edge of the second tape and the first edge of the fourth tape, wherein the second angle may be smaller than the first angle. It is to be understood that the first angle needs not to be less than 130 degrees in this arrangement. The first angle may be arranged closer to a toe region of the shoe upper than the second angle. In this way, the shoe upper offers an improved fit.

It is to be understood that the shoe upper may comprise any number of tapes greater than one. A plurality of angles may be formed between first edges of the tapes such that the angles successively decrease from a toe region towards a heel region of the shoe upper.

The tapes may at least partially overlap such that a first region of the upper comprises a first number of layers and a second region of the upper comprises a second number of layers. The first number of layers may be greater than the second number of layers. It has been found that this arrangement is particularly advantageous to create a first region of increased protection and a second region of increased flexibility for the shoe upper.

The first region may be arranged proximate to a metatarsal region and the second region may be arranged closer to a heel region of the shoe upper than the first region. In many sports, the metatarsal region requires additional support. The second region is preferably closer to a heel region of the shoe upper to allow for a comfortable entry of the foot into the shoe upper.

The shoe upper may further comprise a retaining tape arranged along a direction from a medial region to a lateral region of the shoe upper. In other words, the retaining tape may extend laterally across the foot. In particular, the retaining tape may be arranged in a metatarsal region. It has been found that, for certain applications, it is preferable to increase the support of the foot in the metatarsal region, in order to guarantee a good fit of the shoe upper. For such applications the retaining tape may be advantageous. The retaining tape may have similar properties to the first, second, third, and fourth tapes and in particular the retaining tape, and/or any other tape, may be elastic.

The shoe upper may further comprise a coating that covers at least partially one or more of the tapes. In other words, the coating may cover at least one of the tapes, and for the respective tape, the coating may cover at least partially thereof. The coating may comprise polyurethane or any other suitable material. The coating advantageously improves the water resistance of the shoe upper and prevents dirt from getting into the shoe upper. The coating may also serve to influence other properties of the shoe upper in the coated regions, for example, the tensile strength, the stiffness or the surface friction (e.g., between a ball and the shoe upper) of the shoe upper.

The shoe upper may be laceless. It has been found that shoelaces may be detrimental to the ball-handling properties of a shoe in ball sports, such as football. Therefore, it is advantageous for the shoe upper to be laceless. However, laceless shoe uppers as known in the art do not provide an optimal fit and support of the foot. The shoe upper according to the present invention however overcomes these problems and therefore provides an ideal fit as well as preferable ball-handling properties.

The invention further concerns a shoe comprising a shoe upper according to the present invention. The shoe according to the present invention therefore advantageously provides an excellent fit, good ball-handling properties and a good level of support for the foot.

The invention further concerns a method of producing a shoe upper comprising providing at least a first tape and a second tape, wherein the first tape and/or the second tape are elastic, and wherein the first tape comprises a first edge. The method comprises attaching a second portion of the first edge of the first tape to the second tape, such that a first portion of the first edge of the first tape is not attached to the second tape.

In other words, the first edge of the first tape may be attached to the second tape such that a first portion of the first edge of the first tape is not attached to the second tape and such that a second portion of the first edge of the first tape is attached to the second tape.

Many of the aspects and advantages of the method of producing a shoe upper according to the present invention have already been described in the context of the corresponding aspects of the shoe upper above.

The first portion of the first edge of the first tape may be movable with respect to the second tape when the shoe upper is not worn, as described above.

The method of producing a shoe upper may further comprise arranging the first tape and the second tape to overlap at least partially.

The method of producing a shoe upper may further comprise arranging the first portion of the first edge of the first tape closer to a toe region of the shoe upper than the second portion of the first edge of the first tape.

Attaching the second portion of the first edge of the first tape to the second tape may comprise sewing. Sewing may comprise any method known in the art, for example linear stitches or zigzag stitches, in particular zigzag stitches. The former requires less space, while the latter may provide improved stability.

Sewing may comprise applying tension to the first tape and/or the second tape prior to making a stitch. It is expressly noted that particularly this aspect of sewing may be carried out, irrespective of whether the first portion and the second portion of the first edge of the first tape are (not) attached to the second tape. In other words, for the method of producing a shoe upper, the technique of applying tension prior to making a stitch may be applied to one or more tapes of the shoe upper, which subsequently may be partially attached, entirely attached or not attached to each other.

The first tape may further comprise a second edge arranged opposite of the first edge. Applying tension may comprise pulling the first edge of the first tape by a first distance and the second edge of the first tape by a second distance, wherein the first distance is different from the second distance. Preferably pulling is done along a longitudinal direction of the first edge and the second edge, respectively. Therefore, a tension differential is created between the first edge and the second edge. This tension differential can be used advantageously to create a three-dimensional shape. Also regarding this aspect, it is particularly pointed out that it may be applied, irrespective of whether the first portion and the second portion of the first edge of the first tape are (not) attached to the second tape.

The first edge of the first tape may further comprise a third portion, and the method may further comprise: arranging the third portion adjacent to the second portion but not adjacent to the first portion, such that the third portion of the first edge of the first tape is not attached to the second tape, as described above.

The method of producing a shoe upper may further comprise providing a third tape and arranging the third tape at least partially between the first tape and the second tape, as described above. In particular, the third tape may partially overlap the first tape and partially overlap the second tape.

The third tape may be arranged such that the first edge of the first tape may be at least partially not attached to the third tape. For example, the first edge of the first tape may not be attached to the third tape, except possibly at a point at an end of the first edge of the first tape.

The third tape may comprise a first edge and a second edge arranged opposite of the first edge. Applying tension may, additionally or alternatively, comprise pulling the first edge of the third tape by a third distance and the second edge of the third tape by a fourth distance, wherein the third distance is different from the fourth distance. This principle may be applied to any edges and the corresponding opposing edges of any of the tapes in order to create a tension differential on any of the tapes.

The method of producing a shoe upper may further comprise providing a fourth tape, and attaching a second portion of the first edge of the third tape to the fourth tape such that a first portion of the first edge of the third tape is not attached to the fourth tape.

The method of producing a shoe upper may further comprise arranging the second tape at least partially between the third tape and the fourth tape. In particular, the second tape is arranged to partially overlap the third tape and partially overlap the fourth tape.

The method of producing a shoe upper may further comprise forming a first angle between the first edge of the first tape and the first edge of the third tape of less than 130 degrees, preferably less than 110 degrees. The first angle is preferably greater than 10 degrees, more preferably 30 degrees, most preferably 45 degrees.

The fourth tape of the shoe upper may comprise a first edge. The method of producing a shoe upper may further comprise: forming a second angle between the first edge of the second tape and the first edge of the fourth tape, and wherein the second angle is smaller than the first angle. It is to be understood that the first angle needs not be less than 130 degrees in this arrangement. The first angle may be arranged closer to a toe region of the shoe upper than the second angle. Therefore, the shoe upper offers an improved fit.

The method of producing a shoe upper may further comprise at least partially overlapping the tapes to form a first region of the shoe upper comprises a first number of layers and a second region of the shoe upper comprises a second number of layers, and wherein the first number of layers is greater than the second number of layers.

The method of producing a shoe upper may further comprise arranging the first region proximate to a metatarsal region and arranging the second region closer to a heel region of the shoe upper than the first region.

The method of producing a shoe upper may further comprise arranging a retaining tape along a direction from a medial region to a lateral region of the shoe upper, and attaching the retaining tape to at least one of the tapes.

The method of producing a shoe upper may further comprise covering at least partially one or more of the tapes by a coating. In other words, the coating may cover at least one of the tapes, and for the respective tape, the coating may cover at least partially thereof.

The shoe upper may be laceless, as described above.

The invention further concerns a method of producing a shoe comprising: (a) producing a shoe upper as described herein, and (b) attaching a sole element to the shoe upper.

BRIEF DESCRIPTION OF THE FIGURES

The present invention will be described in more detail with reference to the accompanying figures in the following. These figures show.

DETAILED DESCRIPTION OF THE INVENTION

In the following, only some embodiments of the invention are described in detail. It is to be understood that these exemplary embodiments can be modified in a number of ways and combined with each other whenever compatible and that certain features may be omitted in so far as they appear dispensable.

Figure 1A:
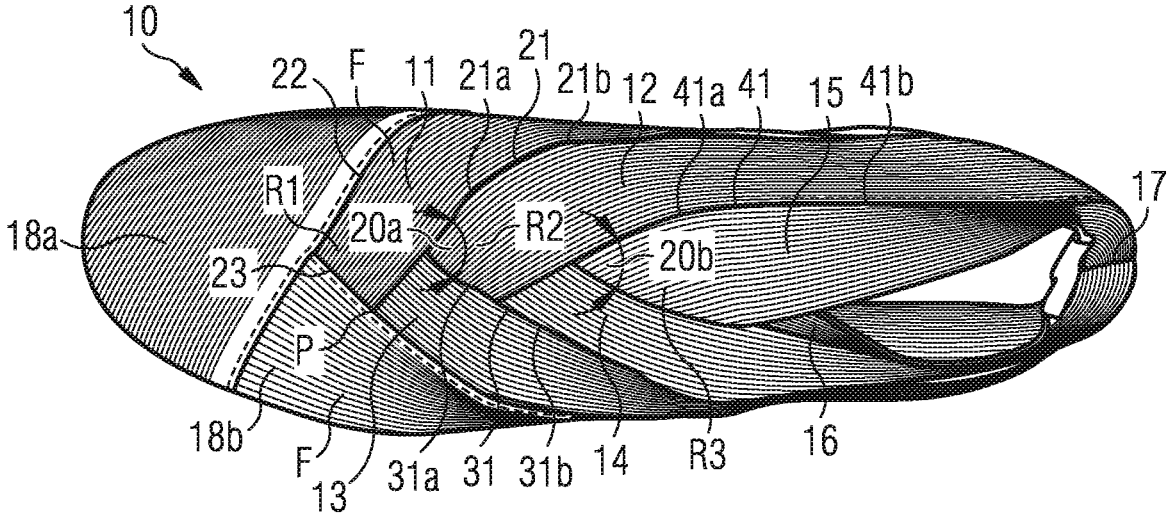
FIG. 1A: a top view of an exemplary shoe upper according to the present invention.
Figure 1B:
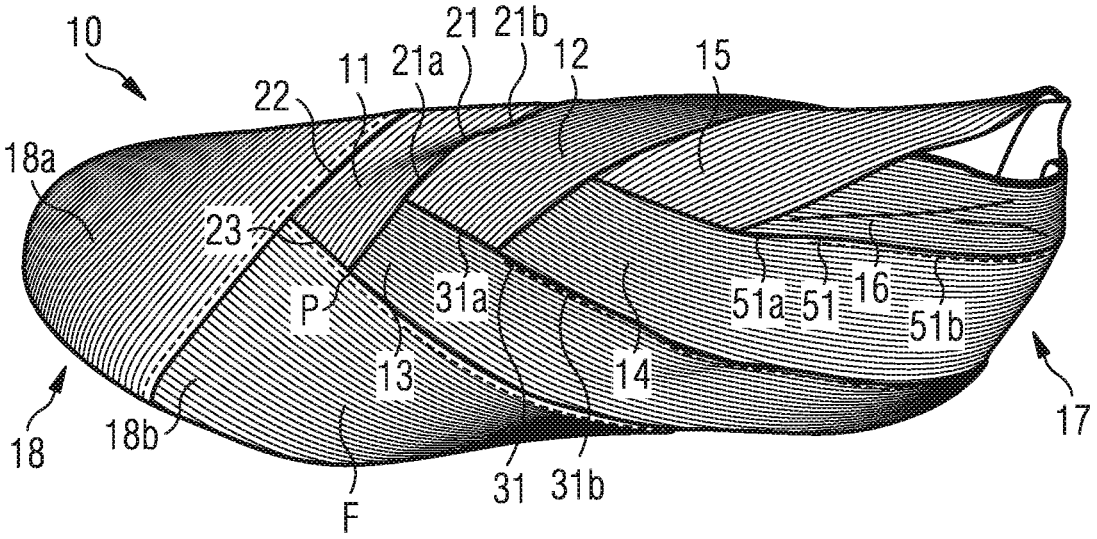
FIG. 1B: a lateral view of an exemplary shoe upper according to embodiments of the present invention.
Figure 1C:
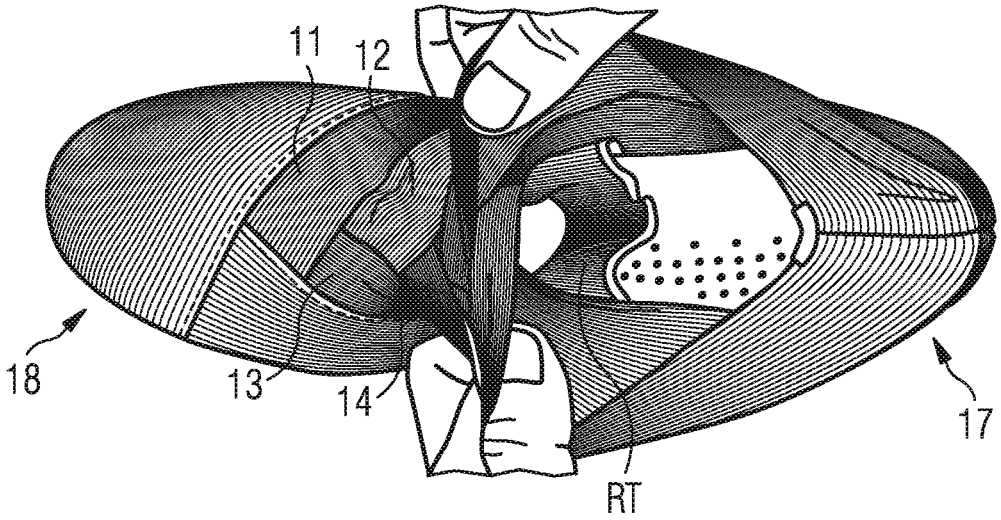
FIG. 1C: a top view of an exemplary shoe upper including a retaining tape according to embodiments of the present invention.

FIGS. 1A-1C show an exemplary shoe upper 10 according to the present invention. FIG. 1A shows a top view, while FIG. 1B shows a lateral view. The shoe upper 10 comprises a first tape 11 and a second tape 12, (a) wherein the first tape 11 comprises a first edge 21, (b) wherein a first portion 21*a* of the first edge 21 of the first tape 11 is not attached to the second tape 12, and (c) wherein a second portion 21*b* of the first edge 21 of the first tape 11 is attached to the second tape 12.

An important feature of the shoe upper 10 according to the present invention is that the first tape 11 and the second tape 12 are only partially attached to each other at a first edge 21 of the first tape 11. However, the first tape 11 and the second tape 12 are attached to each other along a second edge 22 and a third edge 23 which are different from the first edge 21. The third edge 23 is essentially perpendicular to the first edge 21, while the second edge 22 is essentially parallel to the first edge 21. The first tape 11 is attached to a first toe element 18*a* along the second edge 22 and to a second toe element 18*b* along the third edge 23. In this example, each of the first and second toe elements 18*a*, 18*b* comprises a tape. The first and second toe elements 18*a*, 18*b* can be optionally attached to each other, e.g., to form a single element, or can be separate from each other. The exemplary shoe upper 10 is for a football boot.

In particular, the first portion 21*a* of the first edge 21 of the first tape 11 is movable with respect to the second tape 12, as can be best seen in the lateral view shown in FIG. 1B.

The first tape 11 and the second tape 12 overlap partially. It is also possible that the first tape 11 and the second tape 12 overlap entirely.

The first portion 21*a* of the first edge 21 of the first tape 11 is arranged closer to a toe region 18 of the shoe upper 10 than the second portion 21*b* of the first edge 21 of the first tape 11.

The second portion 21*b* of the first edge 21 of the first tape 11 is attached to the second tape 12 by a stitching.

The shoe upper 10 further comprise a third tape 13, arranged partially between the first tape 11 and the second tape 12. The first edge 21 of the first tape 11 is at least partially not attached to the third tape 13. In one example, the first edge 21 of the first tape 11 is not attached to the third tape 13, except at a point P at an end of the first edge 21. The third tape 13 is attached to the first toe element 18*a* along the second edge 22 and to the second toe element 18*b* along the third edge 23. In addition, the third tape 13 comprises a first edge 31, which comprises a first portion 31*a* and a second portion 31*b*.

The shoe upper 10 further comprises a fourth tape 14, wherein the first portion 31*a* of the first edge 31 of the third tape 13 is not attached to the fourth tape 14, and wherein the second portion 31*b* of the first edge 31 of the third tape 13 is attached to the fourth tape 14.

In other words, the third tape 13 and the fourth tape 14 may be only partially attached to each other along the first edge 31 of the third tape 13, similar to the attachment of the first tape 11 and the second tape 12 along the first edge 21 of the first tape 11. In particular, the first portion 31*a* of the first edge 31 of the third tape 13 is movable with respect to the fourth tape 14 as can be best seen in FIG. 1A. Therefore, a good wearing comfort is achieved.

The second tape 12 is arranged partially between the third tape 13 and the fourth tape 14. In other words, the first, second, third, and fourth tapes 11-14 are arranged in a staggered manner. For example, the second tape 12 may partially overlap the third tape 13 and partially overlap the fourth tape 14.

The exemplary shoe upper 10 further comprises a fifth tape 15 and a sixth tape 16, which are arranged analogously to the first tape 11 and the third tape 13 or the second tape 12 and the fourth tape 14, respectively.

The second tape 12 comprises a first edge 41, which comprises a first portion 41*a* and a second portion 41*b*. The first portion 41*a* of the first edge 41 of the second tape 12 is not attached to the fifth tape 15 and the second portion 41*b* of the first edge 41 of the second tape 12 is attached to the fifth tape 15.

The fourth tape 14 comprises a first edge 51, which comprises a first portion 51*a* and a second portion 51*b*. The first portion 51*a* of the first edge 51 of the fourth tape 14 is not attached to the sixth tape 16 and the second portion 51*b* of the first edge 51 of the fourth tape 14 is attached to the sixth tape 16.

The first 11, second 12, and fifth 15 tapes are arranged on a medial side of the shoe upper 10, while the third 13, fourth 14, and sixth 16 tapes are arranged on a lateral side of the shoe upper 10. It is to be understood, that the shoe upper 10 may comprise any number of tapes greater than one. It is also to be understood, that the arrangement of the tapes is not restricted to that shown in FIGS. 1A-C. In particular, the exemplary shoe upper 10 shown in FIGS. 1A-1C is an exemplary shoe upper for a left foot but a shoe upper 10 according to the present invention could equally be for a right foot. The first 11, second 12, and fifth 15 tapes need not be arranged on a medial side. The first 11, second 12, and fifth 15 tapes could alternatively be arranged on a lateral side. The first 11, second 12, and fifth 15 tapes need not even be arranged on a same side (e.g. a lateral or medial side). The same applies analogously to the third 13, fourth 14, and sixth 16 tapes. The third 13, fourth 14, and sixth 16 tapes could be arranged on a medial side alternatively. The third 13, fourth 14, and sixth 16 tapes need not even be arranged on a same side.

A first angle 20*a* formed between the first edge 21 of the first tape 11 and the first edge 31 of the third tape 13 is about 100 degrees. A second angle 20*b* is formed between the first edge 41 of the second tape 12 and the first edge 51 of the fourth tape 14, wherein the second angle 20*b* is smaller than the first angle 20*a*. In this example the second angle is about 45 degrees. The first angle 20*a* is arranged closer to a toe region 18 of the shoe upper 10 than the second angle 20*b*.

The tapes overlap partially such that a first region R1 of the shoe upper comprises six layers of tapes and a second region R2 of the upper comprises only four layers of overlapping tapes. The shoe upper 10 further comprises a third region R3, which comprises only two layers of overlapping tapes.

The first region R1 is arranged proximate to a metatarsal region, the second region R2 is arranged closer to a heel region 17 than the first region R1. The third region R3 is arranged even closer to a heel region 17 than the second region R2.

The shoe upper 10 further comprises a retaining tape RT, as shown in FIG. 1C, wherein the retaining tape RT is arranged along a direction from a medial region to a lateral region of the shoe upper 10. In other words, the retaining tape RT extends laterally across the foot. In this example, the retaining tape RT is arranged on an inner side of the shoe upper, as shown in FIG. 1C. The retaining tape RT will have contact with the foot of a wearer when he/she wears the shoe.

In this example the first 11, second 12, third 13, fourth 14, fifth 15, and sixth 16 tapes and the retaining tape RT comprise a woven textile comprising elastane and polyester. The tapes are therefore elastic. It is also possible that the tapes comprise different materials and/or are produced by different techniques such as a knitted textile or non-woven textile, etc. In particular, only a subset of the tapes may be elastic, while others are not.

The shoe upper 10 further comprises a coating applied as a film F that partially covers the first 11, second 12, third 13 and fourth 14 tapes. The coating comprises polyurethane and applying the film F comprises applying heat and mild pressure in order to soften or partially melt the film, such as to generate a bond with the first 11, second 12, third 13 and fourth 14 tapes.

The exemplary shoe upper 10 is laceless. The shoe upper 10 according to the present invention provides an ideal fit as well as preferable ball-handling properties.

Figure 2:
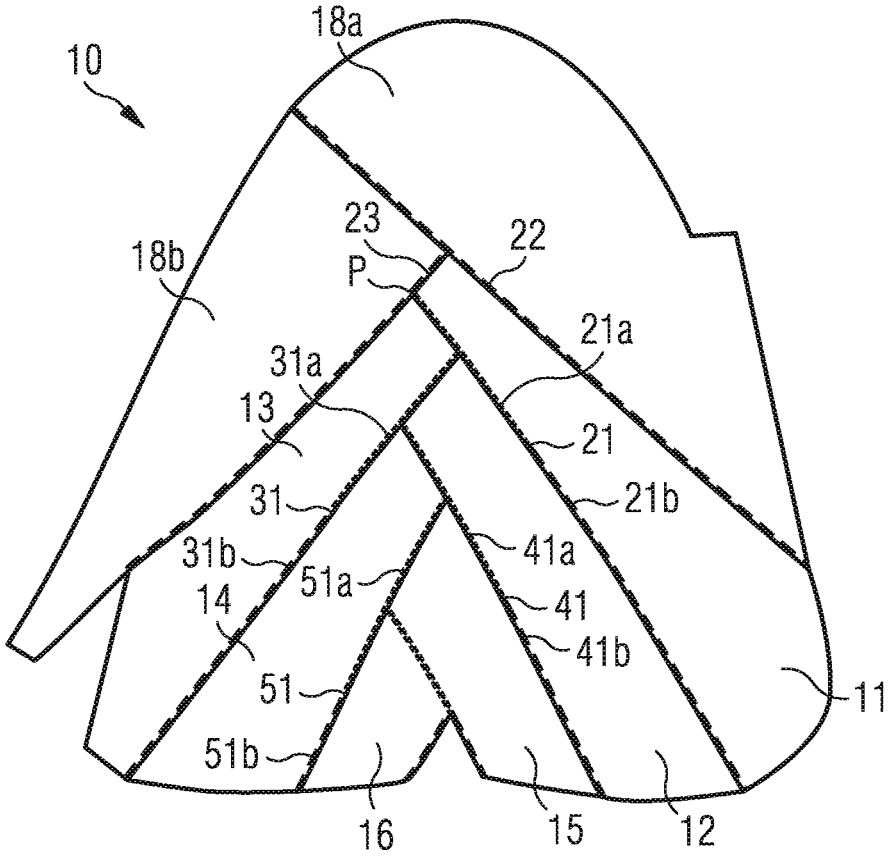
FIG. 2: a schematic of the tapes of an exemplary shoe upper according to the present invention.

FIG. 2 shows a schematic of the tapes of an exemplary shoe upper 10 according to the present invention, illustrating in particular the attachment of the tapes to each other.

The shoe upper 10 comprises a first tape 11 and a second tape 12, (a) wherein the first tape 11 comprises a first edge 21, (b) wherein a first portion 21*a* of the first edge 21 of the first tape 11 is not attached to the second tape 12, and (c) wherein a second portion 21*b* of the first edge 21 of the first tape 11 is attached to the second tape 12.

The first tape 11 is attached to a first toe element 18*a* along a second edge 22 and to a second toe element 18*b* along a third edge 23. The third edge 23 is essentially perpendicular to the first edge 21, while the second edge 22 is essentially parallel to the first edge 21. The first tape 11 and the second tape 12 are attached to each other along the second edge 22 and the third edge 23 which are different from the first edge 21.

The shoe upper 10 further comprises a third tape 13, arranged partially between the first tape 11 and the second tape 12. The first edge 21 of the first tape 11 is at least partially not attached to the third tape 13. In this example, the first edge 21 of the first tape 11 is not attached to the third tape 13, except at a point P at an end of the first edge 21. Similarly, the third tape 13 is attached to the first toe element 18*a* along the second edge 22 and to the second toe element 18*b* along the third edge 23. The third tape 13 further comprises a first edge 31, which comprises a first portion 31*a* and a second portion 31*b*.

The shoe upper 10 further comprises a fourth tape 14. The first portion 31*a* of the first edge 31 of the third tape 13 is not attached to the fourth tape 14, while the second portion 31*b* of the first edge 31 of the third tape 13 is attached to the fourth tape 14.

The second tape 12 is arranged partially between the third tape 13 and the fourth tape 14. In other words, the first 11, second 12, third 13, and fourth 14 tapes are arranged in a staggered manner. In this example, the third tape 13 partially overlaps between the first 11 and the second 12 tapes. The second tape 12 partially overlaps between the third 13 and the fourth 14 tapes at one region and partially overlaps between the first 11 and the fourth 14 tapes at another region.

The exemplary shoe upper 10 further comprises a fifth tape 15 and a sixth tape 16, which are arranged analogously to the arrangement of the first tape 11 and the third tape 13 or the second tape 12 and the fourth tape 14, respectively. It is to be understood, that the shoe upper 10 may comprise any number of tapes greater than one.

Figure 3:
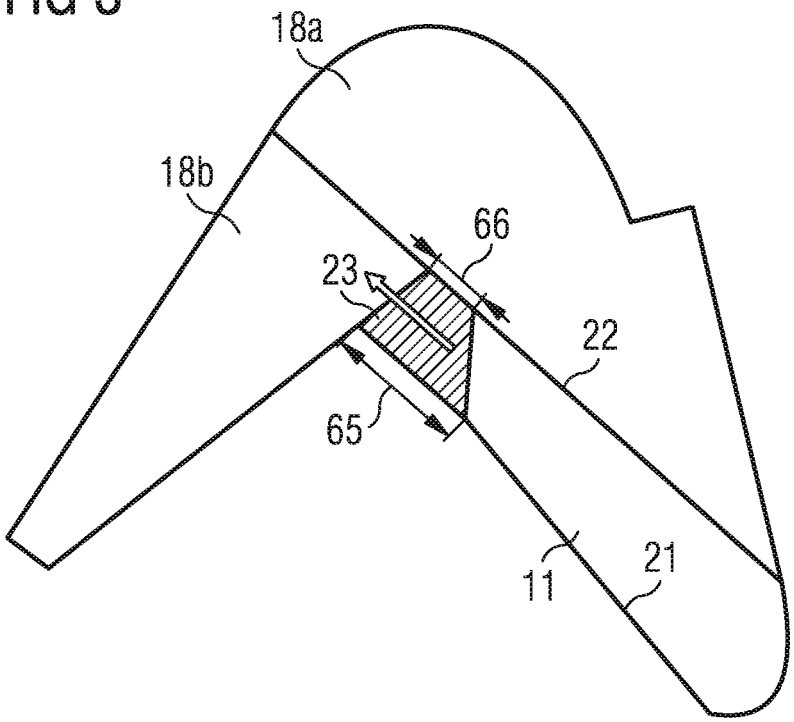
FIG. 3: a schematic of a tension differential on a tape of an exemplary shoe upper according to the present invention.

FIG. 3 illustrates how a tension differential may be applied on a tape of an exemplary shoe upper 10 according to the present invention. In particular, FIG. 3 shows parts of a shoe upper 10 comprising a first tape 11, which is attached to a first toe element 18*a* along the second edge 22 and to a second toe element 18*b* along the third edge 23.

The first tape 11 comprises a first edge 21 and a second edge 22 arranged opposite of the first edge 21. The first tape 11 is attached to the first toe element 18*a* by sewing. Tension is applied on a second edge 22 of the first tape 11 prior to making a stitch to attach the first tape 11 to the first toe element 18*a*. Tension is also applied prior to attaching a second portion 21*b* of a first edge 21 of the first tape 11 to a second tape 12 (not shown). In other words, the first tape 11 is under tension while being sewed to the toe elements and other tapes and when the shoe upper 10 is not worn.

Applying tension on the first tape 11 comprises pulling the first edge 21 by a first distance 65 and the second edge 22 by a second distance 66. The first distance 65 is larger than the second distance 66; therefore the tension is greater along the first edge 21 than along the second edge 22. Pulling is done along a longitudinal direction of the first edge 21 and the second edge 22, respectively. Therefore, a tension differential is created between the first edge 21 and the second edge 22. This tension differential can be used advantageously to create a three-dimensional shape. In should be noted that the tension applied and the distance pulled on the edges of the tapes can be arbitrarily selected according to various demands.

Even though tension is applied to the first tape 11 prior to sewing as described, the first tape 11 remains elastic in the final shoe upper. In this example, the first tape has an elongation at break of 100%, i.e. the first tape 11 may be extended by 100% in length prior to tearing/breaking. Pulling the first edge 21 by a first distance 65 increases the length of the first tape along the first edge 21 by, for example, 20%. Therefore, the remaining capacity for the first tape 11 to stretch along the first edge 21 is, for example, 80% of the original, unstretched length. In other words, the first tape retains its elasticity, despite being pulled into a pre-stretched condition.

Figure 4:
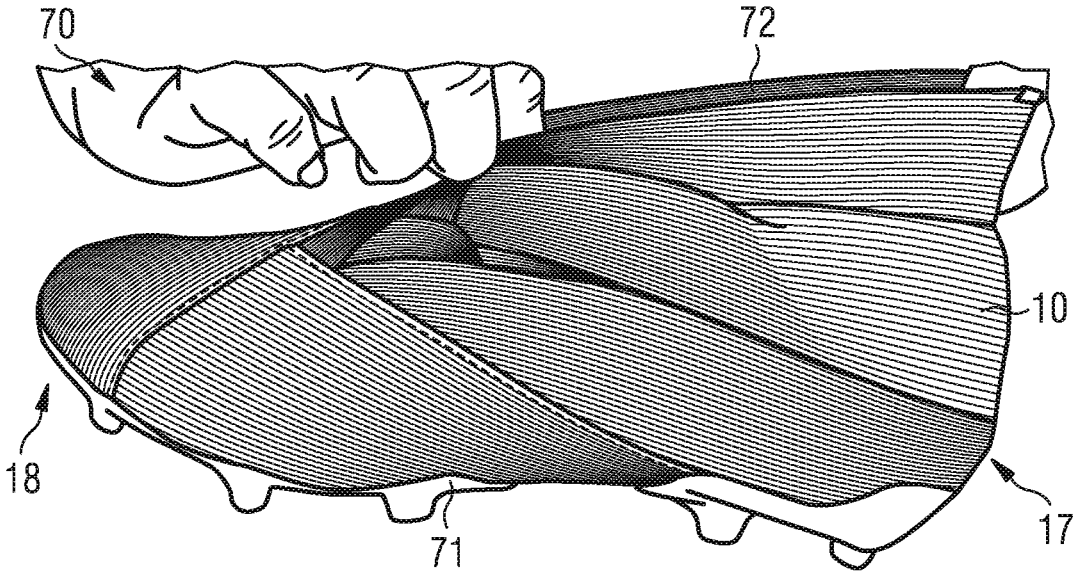
FIG. 4: an exemplary shoe including a shoe upper according to embodiments of the present invention.

FIG. 4 shows an exemplary shoe 70 comprising a shoe upper 10 according to the present invention and a sole element 71 comprising a plurality of studs.

FIG. 4 illustrates how the collar opening 72 of an exemplary shoe upper 10 according to the present invention may be particularly flexible and therefore allow for a particularly easy entry of a foot into the shoe upper 10. The shoe upper 10 also provides sufficient support of the foot, such that the shoe can be worn without laces.

Figure 5:
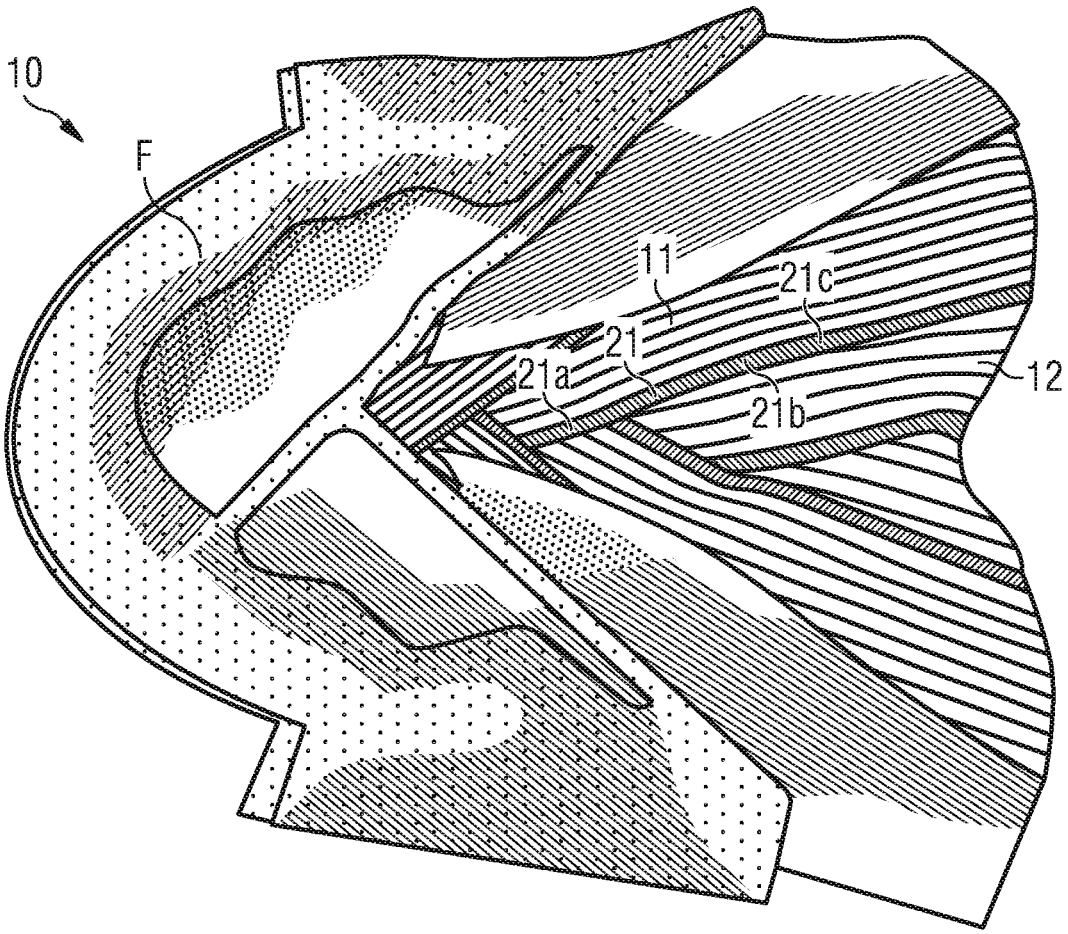
FIG. 5: an exemplary shoe upper according to the present invention in its two-dimensional form.

FIG. 5 shows an exemplary shoe upper 10 according to the present invention in its two-dimensional form.

The shoe upper 10 comprises a first tape 11 and a second tape 12, (a) wherein the first tape 11 comprises a first edge 21, (b) wherein a first portion 21*a* of the first edge 21 of the first tape 11 is not attached to the second tape 12, and (c) wherein a second portion 21*b* of the first edge 21 of the first tape 11 is attached to the second tape 12 by sewing.

The first edge 21 of the first tape 11 further comprises a third portion 21*c* arranged adjacent to the second portion 21*b* but not adjacent to the first portion 21*a*, wherein the third portion 21*c* of the first edge 21 of the first tape 11 is not attached to the second tape 12.

During the manufacture and assembly of a shoe, the shoe upper 10 shown in FIG. 5 may be arranged on a shoe last in order to attach a sole element 71 thereto and thus produce a shoe comprising the shoe upper 10.

REFERENCE SIGNS

10: shoe upper
11: first tape
12: second tape
13: third tape
14: fourth tape
15: fifth tape
16: sixth tape
17: heel region
18: toe region
18*a*, 18*b*: toe element
20*a*: first angle
20*b*: second angle
21: first edge of the first tape
21*a*: first portion of the first edge of the first tape
21*b*: second portion of the first edge of the first tape
21*c*: third portion of the first edge the first tape
22: second edge of the first tape
23: third edge of the first tape
31: first edge of the third tape
31*a*: first portion of the first edge of the third tape
31*b*: second portion of the first edge of the third tape
41: first edge of the second tape
41*a*: first portion of the first edge of the second tape
41*b*: second portion of the first edge of the second tape
51: first edge of the fourth tape
51*a*: first portion of the first edge of the fourth tape
51*b*: second portion of the first edge of the fourth tape
65: first distance
66: second distance
70: shoe
71: sole element
72: collar opening
R1: first region
R2: second region
R3: third region
P: point
F: film
RT: retaining tape

What is claimed is:

1. A shoe upper comprising:
a toe region located forward of a metatarsal region;
a first tape;
a second tape,
wherein the first tape and/or the second tape is elastic,
wherein the first tape comprises a first edge, an inner side facing toward an interior of the shoe upper, and an outer side opposite the inner side,
wherein a first portion of the first edge of the first tape is not attached to the second tape, and
wherein a second portion of the first edge of the first tape is attached to the second tape;
a third tape arranged partially between the first tape and the second tape such that the first tape, the second tape, and the third tape at least partially overlap in the toe region; and
a toe element comprising an edge that overlaps the first tape such that the toe element extends over a portion of the outer side of the first tape,
wherein the first tape, the second tape, and the third tape are attached at the edge of the toe element in the toe region, and
wherein the first portion of the first edge of the first tape is closer to the edge of the toe element than the second portion of the first edge of the first tape.

2. The shoe upper according to claim 1, wherein a part of the first tape or a part of the second tape is in a pre-stretched condition, when the shoe upper is not worn.

3. The shoe upper according to claim 1, further comprising a fourth tape,
wherein the third tape comprises a first edge,
wherein a first portion of the first edge of the third tape is not attached to the fourth tape, and
wherein a second portion of the first edge of the third tape is attached to the fourth tape.

4. The shoe upper according to claim 3, wherein the fourth tape comprises a first edge,
wherein a first angle is formed between the first edge of the first tape and the first edge of the third tape,
wherein a second angle is formed between a first edge of the second tape and the first edge of the fourth tape, and
wherein the second angle is smaller than the first angle.

5. The shoe upper according to claim 1, wherein the first tape and the second tape partially overlap such that a first region of the upper comprises a first number of layers and a second region of the upper comprises a second number of layers, and
wherein the first number of layers is greater than the second number of layers.

6. The shoe upper according to claim 1, further comprising a retaining tape arranged along a direction from a medial region to a lateral region of the shoe upper.

7. A shoe comprising the shoe upper according to claim 1.

8. The shoe upper according to claim 1, wherein the toe element comprises a tape wrapping around the toe region of the upper.

9. The shoe upper according to claim 1, wherein the first tape extends from a medial side to a lateral side of the upper and the second tape extends from the lateral side to the medial side of the upper.

10. A method of producing a shoe upper comprising:

providing a first tape;

providing a second tape, wherein the first tape and/or the second tape is elastic, and wherein the first tape comprises a first edge, an inner side facing toward an interior of the shoe upper, and an outer side opposite the inner side;

providing a third tape, arranging the third tape partially between the first tape and the second tape such that the first tape, the second tape, and the third tape at least partially overlap in a toe region of the upper forward of a metatarsal region of the upper;

attaching a second portion of the first edge of the first tape to the second tape such that a first portion of the first edge of the first tape is not attached to the second tape; and providing a toe element comprising an edge, wherein the first tape, the second tape, and the third tape are attached at the edge of the toe element in the toe region of the upper and the edge of the toe element overlaps the first tape such that the toe element extends over a portion of the outer side of the first tape, and wherein the first portion of the first edge of the first tape is closer to the edge of the toe element than the second portion of the first edge of the first tape.

11. The method of producing a shoe upper according to claim 10, further comprising arranging the first portion of the first edge of the first tape closer to the toe region of the shoe upper than the second portion of the first edge of the first tape.

12. The method of producing a shoe upper according to claim 10, wherein attaching the second portion of the first edge of the first tape to the second tape comprises sewing.

13. The method of producing a shoe upper according to claim 12, wherein sewing comprises applying tension to the first tape and/or the second tape prior to making a stitch.

14. The method of producing a shoe upper according to claim 13, wherein the first tape comprises a second edge arranged opposite of the first edge, wherein applying tension comprises pulling the first edge of the first tape by a first distance and the second edge of the first tape by a second distance, and wherein the first distance is different from the second distance.

15. The method of producing a shoe upper according to claim 10, further comprising providing a fourth tape, and arranging the second tape partially between the third tape and the fourth tape.

16. The method of producing a shoe upper according to claim 15, wherein the third tape comprises a first edge, and wherein the method further comprises:

attaching a second portion of the first edge of the third tape to the fourth tape such that a first portion of the first edge of the third tape is not attached to the fourth tape.

17. The method of producing a shoe upper according to claim 16, wherein the fourth tape comprises a first edge, and wherein the method further comprises:

forming a first angle between the first edge of the first tape and the first edge of the third tape; and forming a second angle between the first edge of the second tape and the first edge of the fourth tape, wherein the second angle is smaller than the first angle.

18. The method of producing a shoe upper according to claim 10, further comprising partially overlapping the first tape and the second tape to form a first region of the upper comprising a first number of layers and a second region of the upper comprising a second number of layers, wherein the first number of layers is greater than the second number of layers.

19. The method of producing a shoe upper according to claim 10, further comprising arranging a retaining tape along a direction from a medial region to a lateral region of the shoe upper, and attaching the retaining tape to at least one of the first tape or the second tape.

20. A method of producing a shoe, comprising:

producing a shoe upper according to claim 10; and attaching a sole element to the shoe upper.

21. A shoe comprising:

a shoe upper comprising:

a first tape, a second tape, a third tape including a first end and a second end and arranged partially between the first tape and the second tape, a fourth tape, and a toe element sewn to the first tape; and a sole element, wherein the first end of the third tape is attached to the sole element and the second end of the third tape is sewn to the toe element, wherein the second tape is arranged partially between the third tape and the fourth tape, wherein the first tape and/or the second tape is elastic, wherein the first tape comprises a first edge, wherein a first portion of the first edge of the first tape is not attached to the second tape, wherein a second portion of the first edge of the first tape is attached to the second tape, and wherein the first tape and the second tape are essentially parallel.

22. The shoe according to claim 21, wherein the third tape is essentially perpendicular to the first tape and the second tape.

* * * * *